US011198041B2

(12) United States Patent
Oh

(10) Patent No.: US 11,198,041 B2
(45) Date of Patent: Dec. 14, 2021

(54) PANEL OF BALL FOR BALL GAME AND BALL INCLUDING THE SAME

(71) Applicant: SSAKA CO., LTD., Seoul (KR)

(72) Inventor: Jeong Seok Oh, Seoul (KR)

( * ) Notice: Subject to any disclaimer, the term of this patent is extended or adjusted under 35 U.S.C. 154(b) by 0 days.

(21) Appl. No.: 17/063,727

(22) Filed: Oct. 6, 2020

(65) Prior Publication Data

US 2021/0121743 A1 Apr. 29, 2021

(30) Foreign Application Priority Data

Oct. 24, 2019 (KR) ..... 10-2019-0132732

(51) Int. Cl.
*A63B 41/08* (2006.01)

(52) U.S. Cl.
CPC ..... *A63B 41/08* (2013.01)

(58) Field of Classification Search
CPC ..... A63B 41/08; A63B 41/00; A63B 41/085; A63B 2243/0037; A63B 2243/0025
USPC ..... 473/603–605
See application file for complete search history.

(56) References Cited

U.S. PATENT DOCUMENTS 1,209,644 A * 12/1916 Price ..... B29C 66/71 156/292
RE15,108 E * 5/1921 Fukuda ..... A63B 37/00 473/604
2,280,314 A * 4/1942 Scudder ..... B29C 51/16 156/213
2,998,977 A * 9/1961 Molitor ..... A63B 37/0076 473/354
4,653,758 A * 3/1987 Solheim ..... A63B 37/0003 264/239
5,104,125 A * 4/1992 Wilson ..... A63F 9/12 273/157 R
5,411,262 A * 5/1995 Smith ..... A63F 9/12 273/156
5,636,835 A * 6/1997 Schindler ..... A63B 41/08 473/605
5,711,729 A * 1/1998 Chan ..... A63B 37/0098 473/609
5,931,752 A * 8/1999 Guenther ..... A63B 41/08 473/597
8,926,459 B2 * 1/2015 Berggren ..... A63B 45/00 473/604

(Continued)

FOREIGN PATENT DOCUMENTS

JP 3019826 1/1996
KR 20-0171508 3/2000

(Continued)

OTHER PUBLICATIONS

English abstract of 3019826.

(Continued)

*Primary Examiner* — Steven B Wong
(74) *Attorney, Agent, or Firm* — Antonio Ha & U.S. Patent, LLC

(57) ABSTRACT

The present disclosure relates to a panel for ball game ball and a ball game ball including the same, and more particularly, to a panel for ball game ball and a ball game ball including the same capable of facilitating the coupling between adjacent panels and improving an adhesive strength between the panels when attaching a plurality of panels forming a surface of the ball game ball.

5 Claims, 10 Drawing Sheets

(56) References Cited

U.S. PATENT DOCUMENTS

| | | | | |
|---|---|---|---|---|
| 9,114,286 | B2 * | 8/2015 | Krysiak | A63B 41/08 |
| 9,821,195 | B2 * | 11/2017 | Raynak | A63B 41/04 |
| 9,950,217 | B1 * | 4/2018 | Chuang | A63B 45/00 |
| D885,251 | S * | 5/2020 | Hartloff | D11/157 |
| 2005/0248090 | A1 * | 11/2005 | Anders | A63F 9/0865 273/156 |
| 2008/0197566 | A1 * | 8/2008 | Lee | A63F 9/1208 273/157 R |
| 2012/0329587 | A1 * | 12/2012 | Ou | A63B 45/00 473/605 |

FOREIGN PATENT DOCUMENTS

| | | |
|---|---|---|
| KR | 10-2002-0080299 | 10/2002 |
| KR | 10-2015-0083536 | 7/2015 |

OTHER PUBLICATIONS

English abstract of 10-2015-0083536.
English abstract of 10-2002-0080299.
English abstract of 20-0171508.

* cited by examiner

PANEL OF BALL FOR BALL GAME AND BALL INCLUDING THE SAME

This application claims the priority benefit of Korean Patent Application No. 10-2019-0132732 filed on Oct. 24, 2019, which is incorporated herein by reference for all purposes as if fully set forth herein.

TECHNICAL FIELD

The present disclosure relates to a panel for ball game and a ball for ball game (hereinafter referred to as "ball game ball") including the same, and more particularly, to a panel for ball game ball with conductivity and a ball game ball including the same capable of facilitating the coupling between adjacent panels and improving an adhesive strength between the panels when attaching the plurality of panels to a surface of the ball game ball.

Balls for ball games including soccer balls, volleyball balls, handball balls, etc. generally have a structure in which a reinforcing layer made of a fabric-like material is provided on an outer surface of a tube, and outer circumferential mike of the reinforcing layer is covered with a plurality of panels made of a material such a leather or artificial fiber.

A method, in which a person sews the panels with threads, is mainly used for the balls for ball games.

However, the method of covering the reinforcing layer by sewing the panels with threads has problems in that work efficiency and productivity are reduced, the manufacturing cost increases, and waterproofness is deteriorated, since a person must manually sew the panels.

In addition, in various ball games, various electronic measuring devices have been recently used to relay the game situation or determine whether an outline is present. Thus, there is an increasing need for balls for ball game with conductivity so as to electrically interact with these electronic measuring devices.

SUMMARY

An object of the present disclosure is to address the above-described and other problems. Another object of the present disclosure is to provide a panel for ball game ball and a ball game ball including the same capable of facilitating the coupling between adjacent panels and improving an adhesive strength between the panels when attaching the plurality of panels forming a surface of the ball game ball.

Another object of the present disclosure is to provide a ball game ball, of which a surface has conductivity or in which an electronic chip capable of wired and wireless communication is installed inside the ball game ball so that the ball game ball can electrically or electronically communicate with an electronic measuring device installed outside the ball game ball.

Technical problems to be solved by the present disclosure are not limited by the above-mentioned technical problems, and other technical problems which are not mentioned above can be clearly understood from the following description by those skilled in the art to which the present disclosure pertains.

To achieve the above-described and other objects, in one aspect, there is provided a panel (100) for ball game ball, that includes a plurality of panels and is attached by an adhesive to form a surface of a ball game ball (10), the panel for ball game ball comprising an attachment plate (110); and a female fastening portion (170) or a male fastening portion (130) included in the attachment plate (110), wherein the female and male fastening portions (120, 130) allow the panels (100) forming the surface of the ball game ball (10) to be attached to each other.

A plurality of sides (111) is formed around the attachment plate (110). The female fastening portion (120) includes a female fastening protrusion (121) included in at least one of the plurality of sides (111), and the male fastening portion (130) includes a male fastening protrusion (131) included in a side, among the plurality of sides (111), in which the female fastening portion (120) is not included.

The female fastening protrusion (121) is extended from a lower part of the side (111) to the outside and the male fastening protrusion (131) is extended from an upper part of the side (111) to the outside to attach the two adjacent panels (100). The male fastening protrusion (131) included in one attachment plate is attached to an upper part of the female fastening protrusion (121) included in another attachment plate.

The female fastening protrusion (121) includes a pair of upper and lower female fastening protrusions, the male fastening protrusion (131) included in one attachment plate is inserted and attached between the pair of female fastening protrusions (121) included in another attachment plate.

At least one of the female and male fastening portions (120, 130) is made of a different material from the attachment plate (110).

One fastening protrusion of the female and male fastening protrusions (121, 131) has a coupling space (122) in a mutually adjoining surface, and the other fastening protrusion includes a coupling protrusion (132) coupled into the coupling space (122).

In another aspect, there is provided a panel for ball game ball comprising an attachment plate having a plurality of sides around the attachment plate; a female fastening portion including a female fastening protrusion included in at least one of the plurality of sides; and a male fastening portion including a male fastening protrusion included in a side, among the plurality of sides, in which the female fastening portion is not included, wherein the female fastening portion and the male fastening portion are attached to each other by an adhesive to form a surface of a ball game ball, wherein the female fastening protrusion and the male fastening protrusion are extended to the outside by a predetermined length so that the male fastening protrusion included in one attachment plate is attached to an upper part or a lower part of the female fastening protrusion included in another attachment plate, wherein a first carbon fiber sheet is further disposed between the female fastening protrusion and the male fastening protrusion, and the first carbon fiber sheet is formed by weaving a plurality of carbon fiber strands and has a flat rectangular shape.

A printed circuit board is disposed on a lower surface of the first carbon fiber sheet, and a second carbon fiber sheet is disposed on an upper surface of the first carbon fiber sheet. The first and second carbon fiber sheets are metal-coated carbon fibers in which a metal is coated on a surface of a carbon fiber, and have conductivity.

A male cut groove with a predetermined height and length is formed in the rear of the male fastening protrusion, and a female cut groove with a predetermined height and length is formed in the rear of the female fastening protrusion. The printed circuit board, both ends of the first carbon fiber sheet, and one end of the second carbon fiber sheet are inserted into the male cut groove and the female cut groove.

One side of the second carbon fiber sheet is made of a plurality of carbon fiber strands, upward bends to pass between the adjacent panels, and protrudes to the outside of the panel.

In another aspect, there is provided a ball game ball including a panel (100) according to at least one aspect of the present disclosure.

The present disclosure can facilitate the coupling between adjacent panels and improve an adhesive strength between the panels when attaching a plurality of panels forming a surface of a ball game ball.

The present disclosure can transfer an external signal to a printed circuit board installed inside a ball game ball or transfer a signal sensed by the printed circuit board to an electronic device installed outside the ball game ball by wiredly/wirelessly connecting the electronic device to the printed circuit board embedded in the ball game ball because a carbon fiber sheet with conductivity protrudes to the outside of the ball game ball by a predetermined length.

The present disclosure can allow a ball game ball to electrically or electronically communicate With an electronic measuring device installed outside the ball game ball and allow an electronic chip installed inside the ball game ball to wiredly/wirelessly communicate with the electronic measuring device through a carbon fiber strand, since the carbon fiber strand with conductivity protrudes to the surface of the ball game ball by a predetermined length.

Effects obtainable from the present disclosure are not limited by the effects mentioned above, and other effects which are not mentioned above can be clearly understood from the following description by those skilled in the art to which the present disclosure pertains.

BRIEF DESCRIPTION OF THE DRAWINGS

The accompanying drawings, which are included to provide a further understanding of the disclosure and constitute a part of the detailed description, illustrate embodiments of the disclosure and together with the description serve to explain the principle of the disclosure.

DETAILED DESCRIPTION

Reference will now be made in detail to embodiments of the disclosure, examples of which are illustrated in the accompanying drawings.

Referring to FIGS. 1 to 8, the present disclosure includes a plurality of panels 100 that is attached to each other by an adhesive to form a surface of a ball for a ball game (hereinafter, referred to as "ball game ball") 10, and the panel 100 for ball game ball includes an attachment plate 110 and a female fastening portion (or a female fastening means) 120 or a male fastening portion (or a male fastening means) 130 formed around the attachment plate 110.

Figure 4:
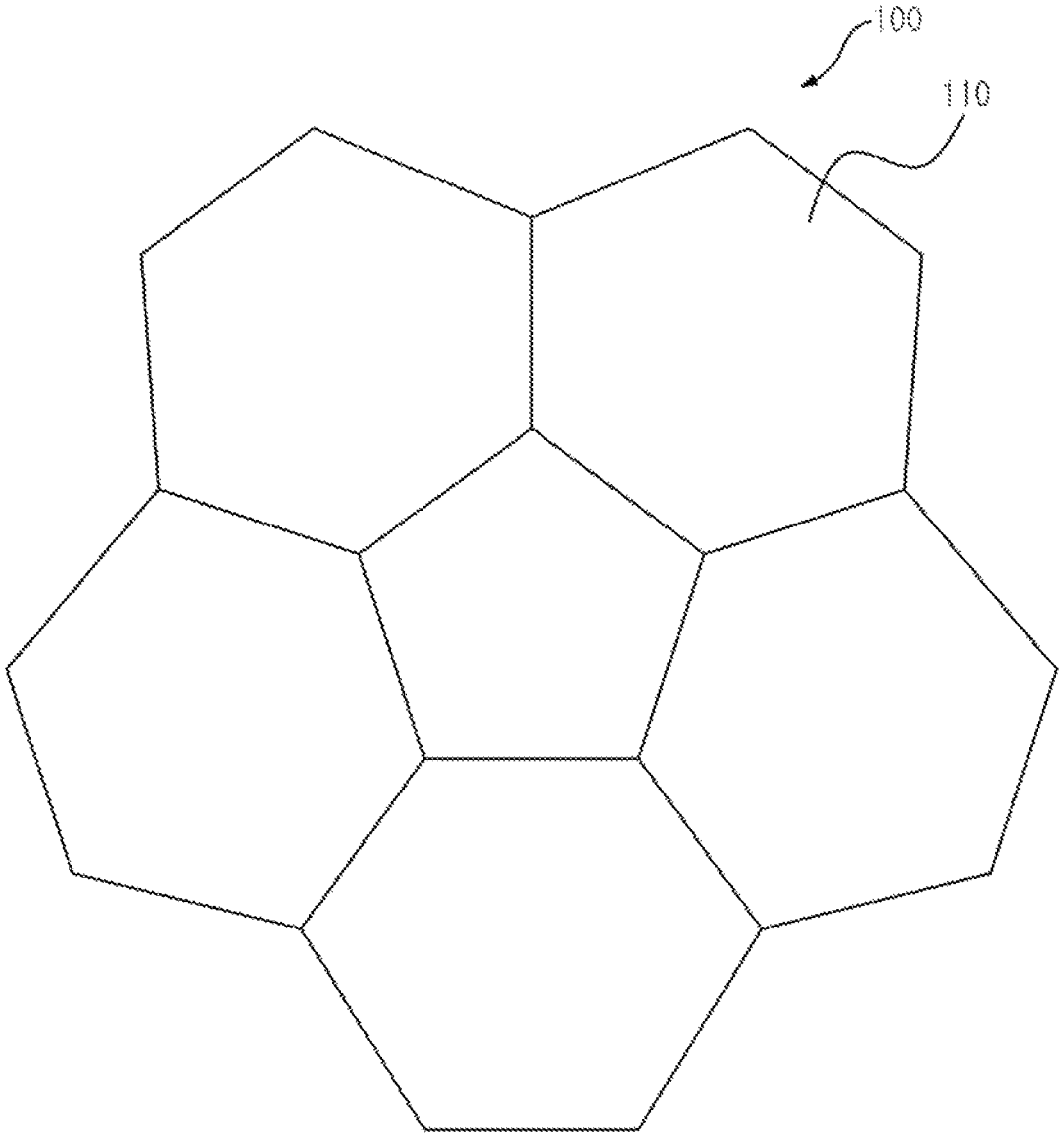
FIGS. 4 and 5 are plan views illustrating that a plurality of panels for ball game ball according to an embodiment of the present disclosure is attached.
Figure 5:
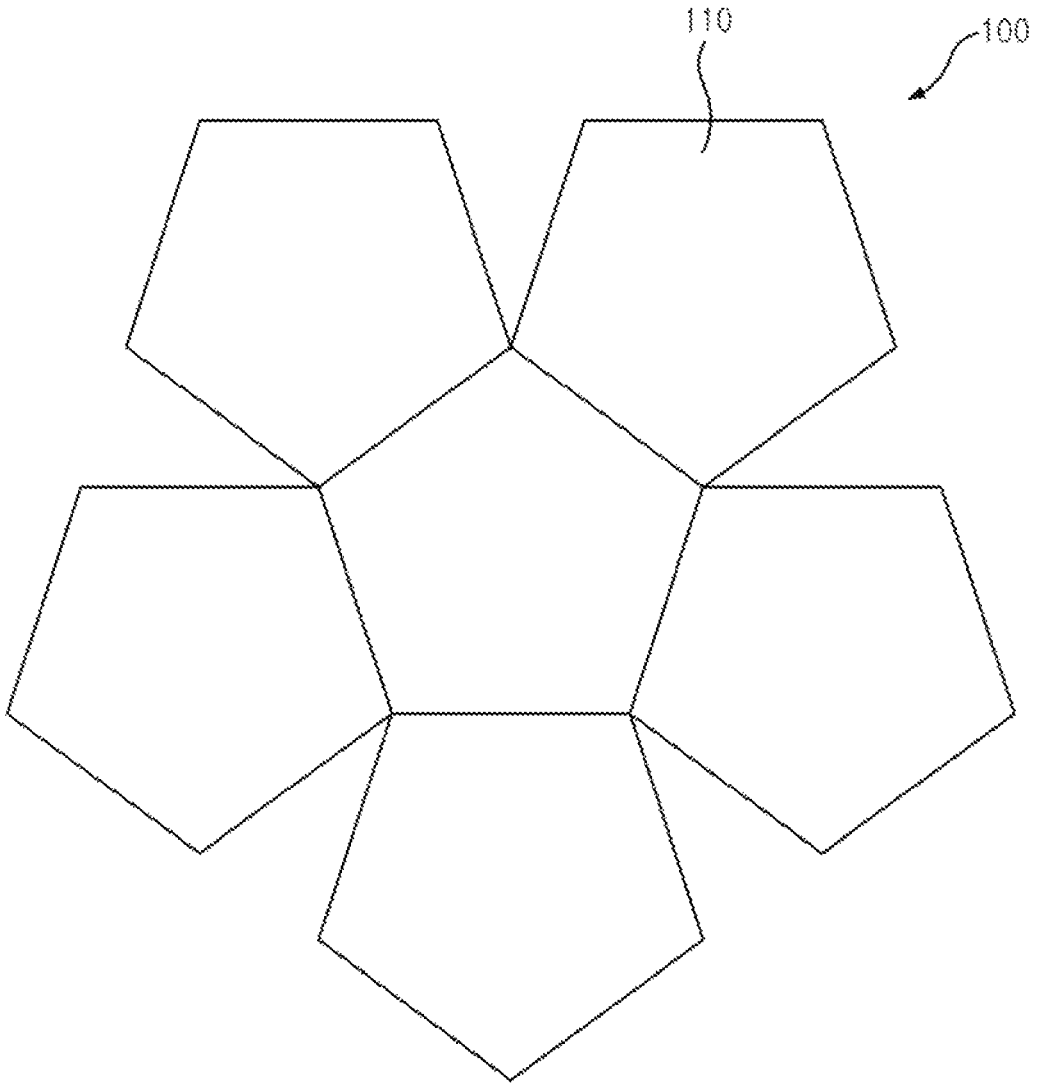

As illustrated in FIGS. 4 and 5, the female and male fastening portions 120 and 130 can allow the panels 110 to be stably attached to each other.

Figure 1:
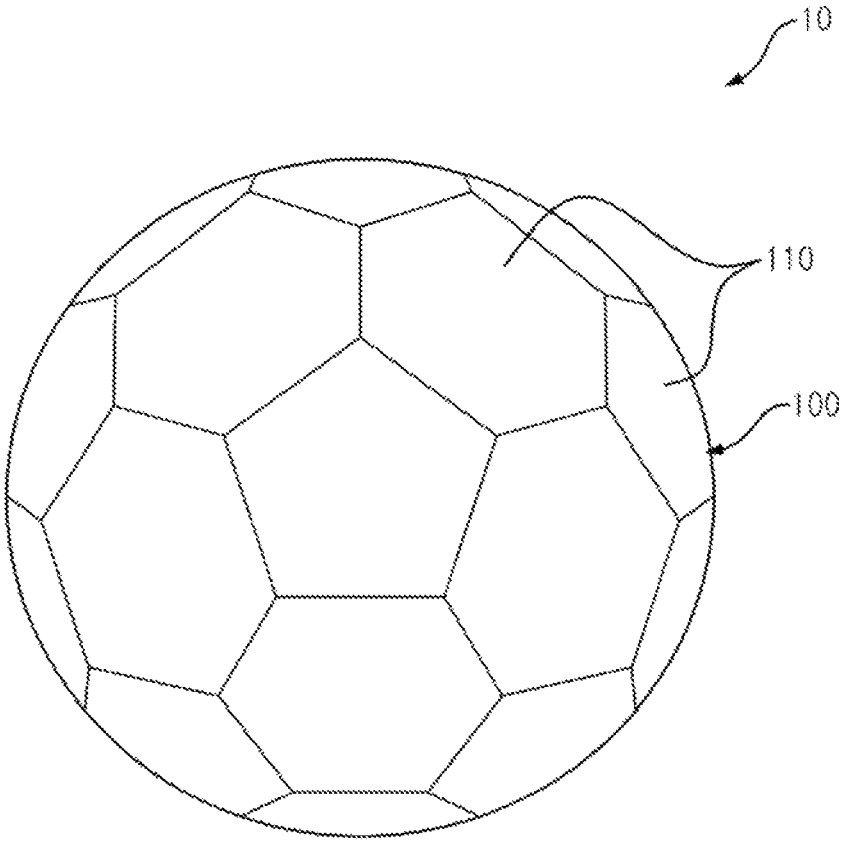
FIG. 1 is a front view illustrating a ball game ball having a panel according to an embodiment of the present disclosure.

That is, as illustrated in FIG. 1, the female and male fastening portions 120 and 130 can allow the adjacent panels 100 to be attached to each other by the adhesive when the plurality of panels 100 is attached to the surface of the ball game ball 10.

Since the panel 100 for ball game ball includes a plurality of panels and is attached to the surface of the ball game ball 10, at least one of the female and male fastening portions 120 and 130 is included in the attachment plate 110 and can attach two attachment plates 110, i.e., two panels 100. Thus, the plurality of panels 100 may include a type in which only the female fastening portion 120 or only the male fastening portion 130 is included in the attachment plate 110, or a type in which both the female and male fastening portions 120 and 130 are included together in the attachment plate 110.

Examples of the ball game ball 10 may include a soccer ball, a volleyball ball, and a handball ball. The present disclosure is described based on the soccer ball, by way of example.

The ball game ball, for example, the soccer ball generally has a structure in which a plurality of panels, for example, 32 or 36 panels of a pentagonal or hexagonal shape, etc. are provided on the surface of the soccer ball and connected by sewing.

Because the panels for the ball game ball are connected by sewing, the ball game ball has a problem in that the work efficiency is reduced, and moisture is introduced through holes through which the thread passes, resulting in a reduction in waterproofness.

The panels 100 for the ball game ball according to the present disclosure can improve the work efficiency and the waterproofness by attaching the panels 100 using the adhesive.

Figure 2:
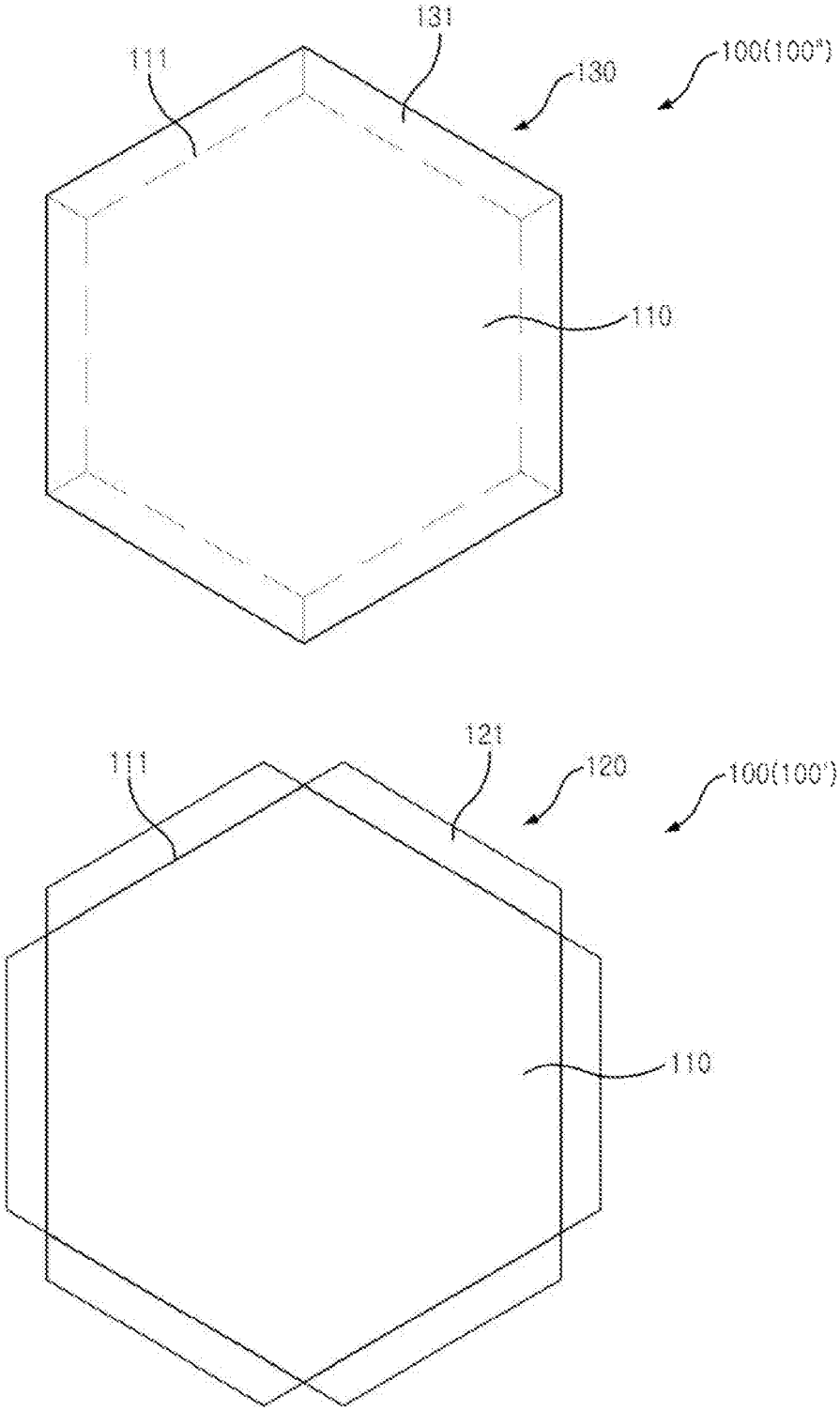
FIGS. 2 and 3 are plan views illustrating a panel for ball game ball according to an embodiment of the present disclosure.
Figure 3:
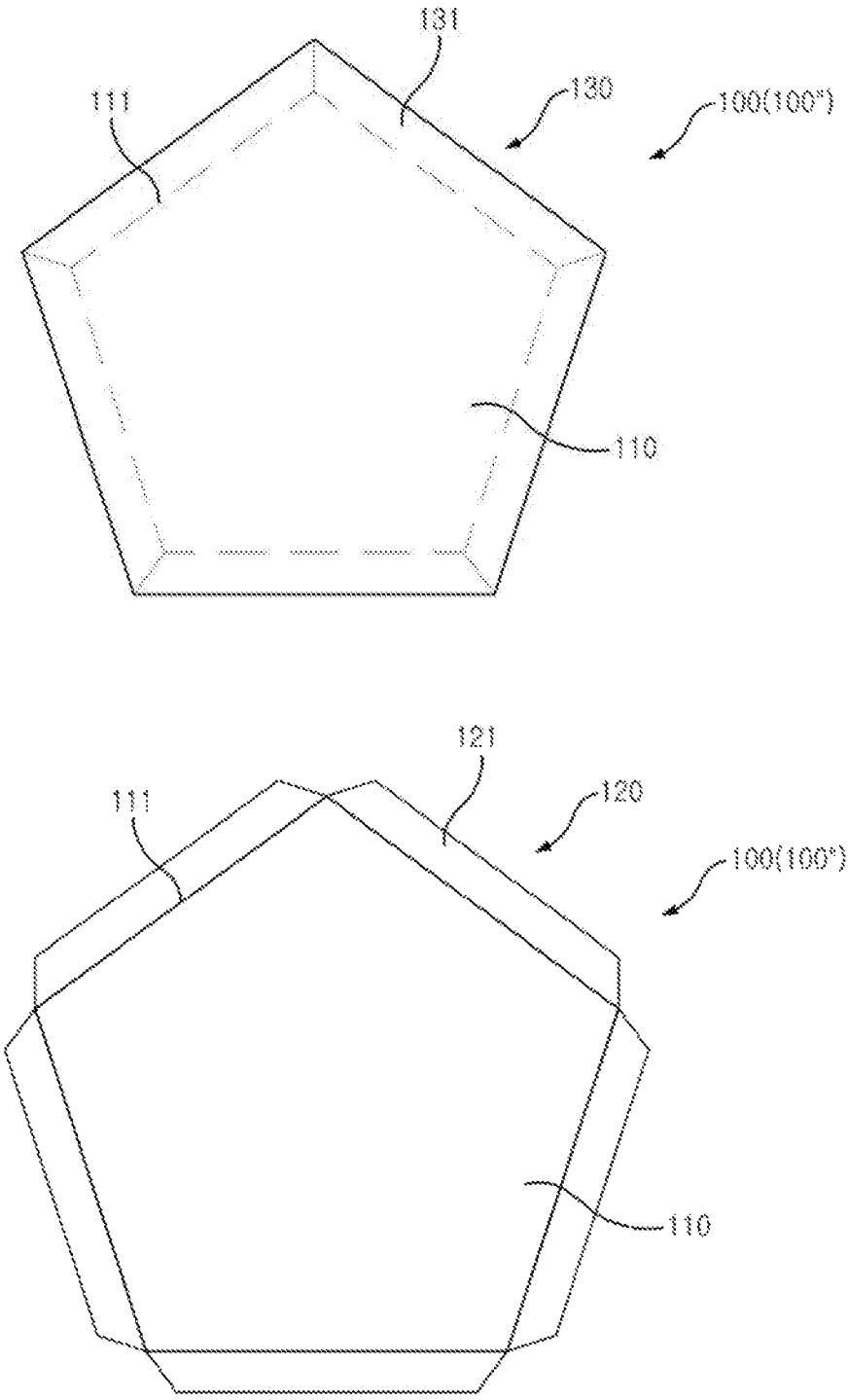

The attachment plate 110 is made of leather, artificial fiber, etc. and has a lower surface and a plurality of sides 111 forming a pentagon or a hexagon as illustrated in FIGS. 2 and 3. The lower surface of the attachment plate 110 may be understood as the surface on which the ball game ball 10 is seated.

The plurality of attachment plates 110 may have the same shape or at least two shapes. For example, the plurality of attachment plates 110 may all have a pentagonal shape, or have pentagonal and hexagonal shapes.

Referring to FIGS. 2 and 3, the female fastening portion 120 includes a female fastening protrusion 121 included in at least one of the plurality of sides 111.

The male fastening portion 130 includes a male fastening protrusion 131 included in a side, among the plurality of sides 111 in which the female fastening portion 120 is not included.

Hence, the panel 100 may include the plurality of attachment plates 110 in which the female fastening portion 120 or the male fastening portion 130 is formed on all the sides of the attachment plate 110, or both the female and male fastening portions 120 and 130 are formed together on all the sides 111.

Figure 6:
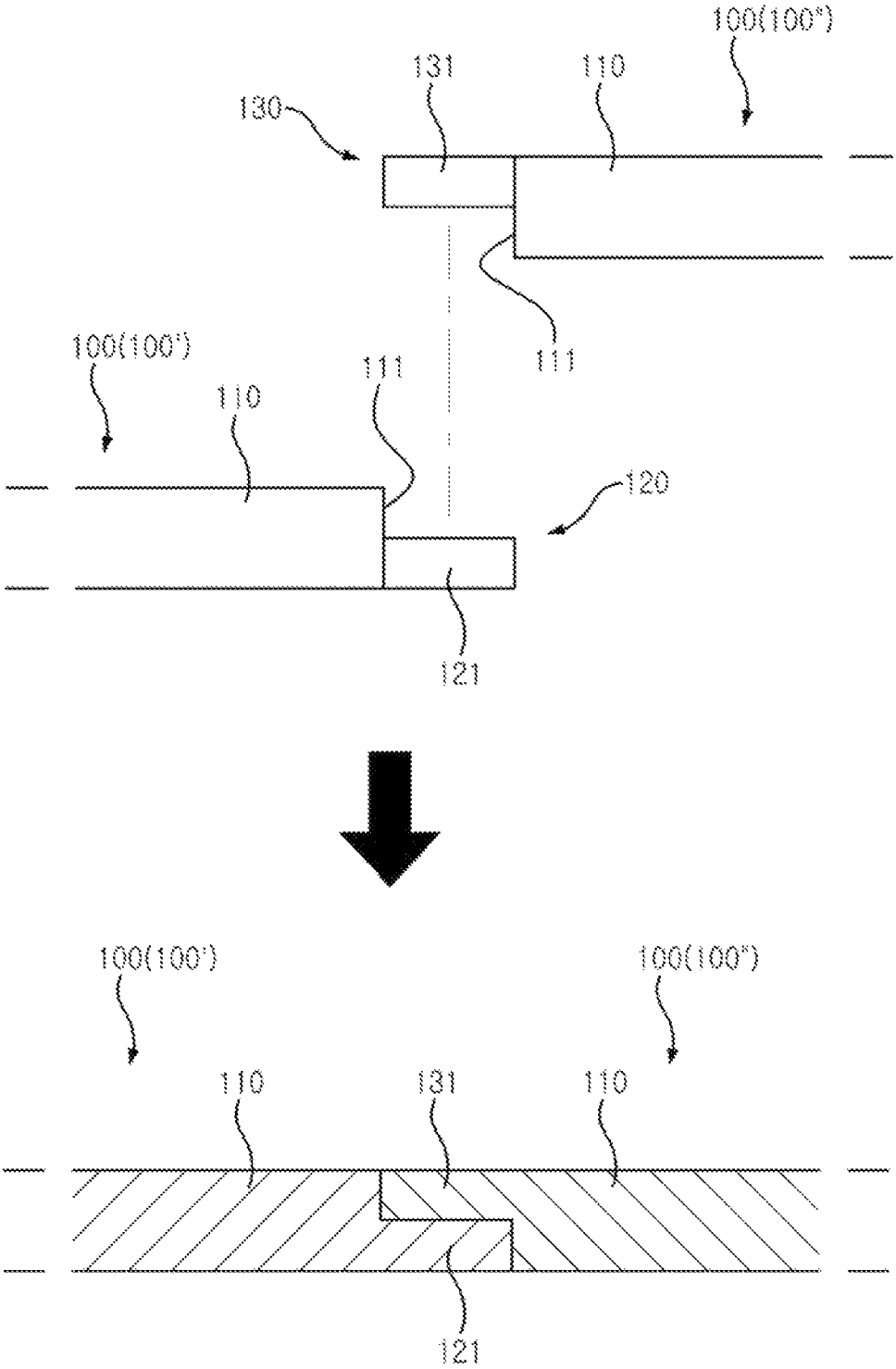
FIG. 6 is a partial enlarged coupling view illustrating that panels of FIGS. 4 and 5 are attached.

As illustrated in FIG. 6, when the female fastening protrusion 121 is extended from a lower pan of the side 111 to the outside and the male fastening protrusion 131 is extended from an upper part of the side 111 to the outside. When the two adjacent panels 100 are attached, a male fastening protrusion 131 included in one panel 100' may be attached to an upper part of a female fastening protrusion 121 included in another panel 100".

If the female fastening protrusion 121 is made of the same material as the attachment plate 110, the female fastening protrusion 121 may be integrally formed with the attachment plate 110 by pressing an edge of the attachment plate 110 from top to bottom.

On the contrary, if the male fastening protrusion 131 is made of the same material as the attachment plate 110, the male fastening protrusion 131 may be integrally formed with the attachment plate 110 by pressing an edge of the attachment plate 110 from bottom to top.

In this instance, fastening portion included in the plurality of sides 111 may be at least partially cut off or may be integrally connected.

Figure 7:
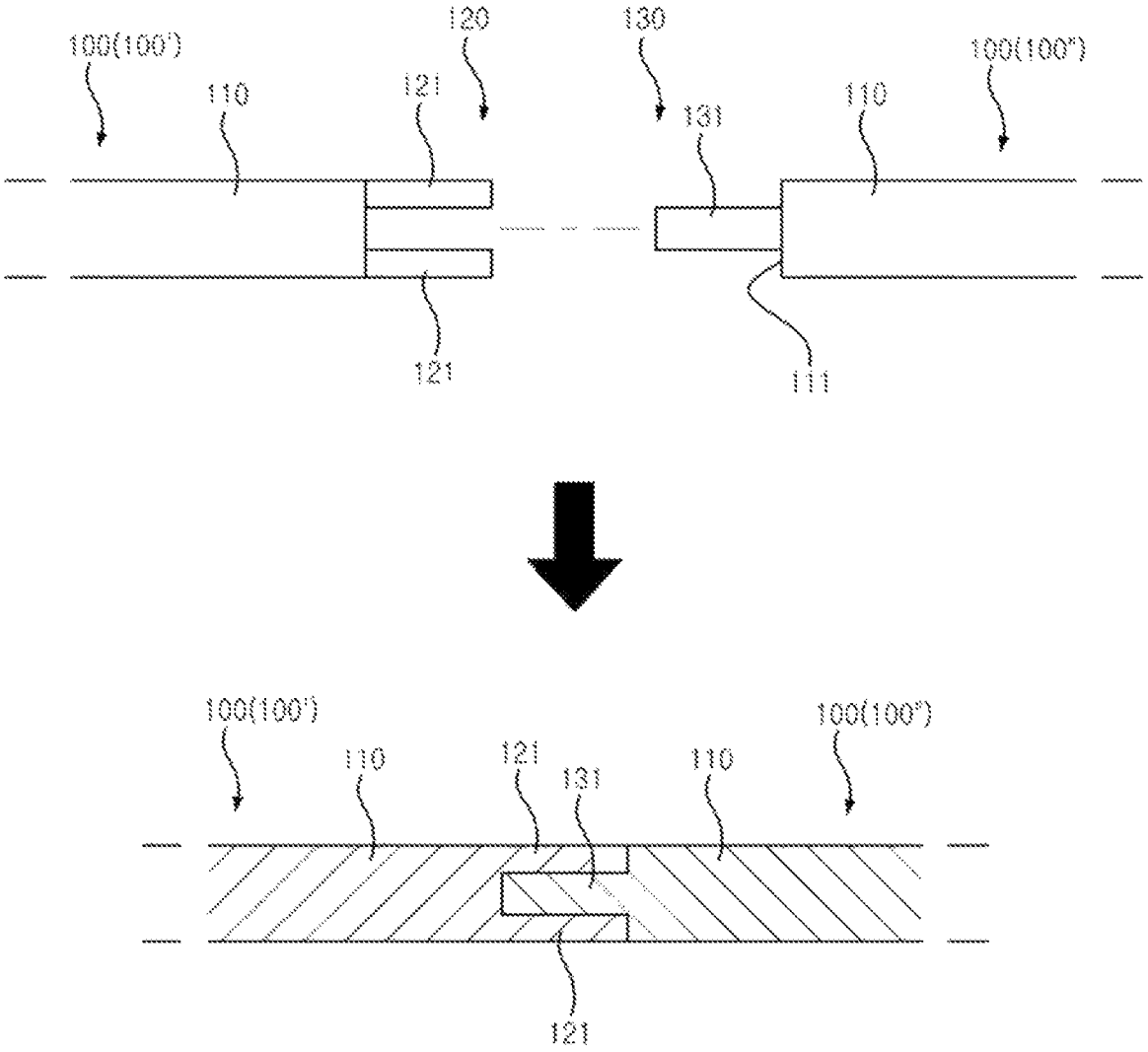
FIG. 7 is a partial enlarged coupling view illustrating an example of female and male fastening protrusions of FIG. 6.

As illustrated in FIG. 7, when the female fastening protrusions 121 are formed in a pair and are positioned on an upper part and a lower part of the side 111. The male fastening protrusion 131 is positioned in the center of the side 111. A male fastening protrusion 131 included in one panel 100' may be inserted and attached between a pair of female fastening protrusions 121 included in another panel 100".

To this end, if the female fastening protrusion 121 is made of the same material as the attachment plate 110, a pair of female fastening protrusions 121 may divide the perimeter of the attachment plate 110 and then integrally formed with the attachment plate 110 through the pressurization or the polishing.

On the other hand, if the male fastening protrusion 131 is made of the same material as the attachment plate 110, the male fastening protrusion 131 may be integrally formed with the attachment plate 110 and may be positioned in the center of the side by pressing an edge of the attachment plate 110 from top to bottom.

The female and male fastening protrusions 121 and 131 may be made of a different material from the attachment plate 110, in order to improve an adhesive strength and enhance rigidity by the adhesive.

For example, at least one of the female and male fastening protrusions 121 and 131 may be made of silicon.

It is preferable that a protrusion, among the female and male fastening protrusions 121 and 131, which forms the surface of the ball game ball 10 and is exposed to the outside is made of the same material as the attachment plate 110.

Figure 8:
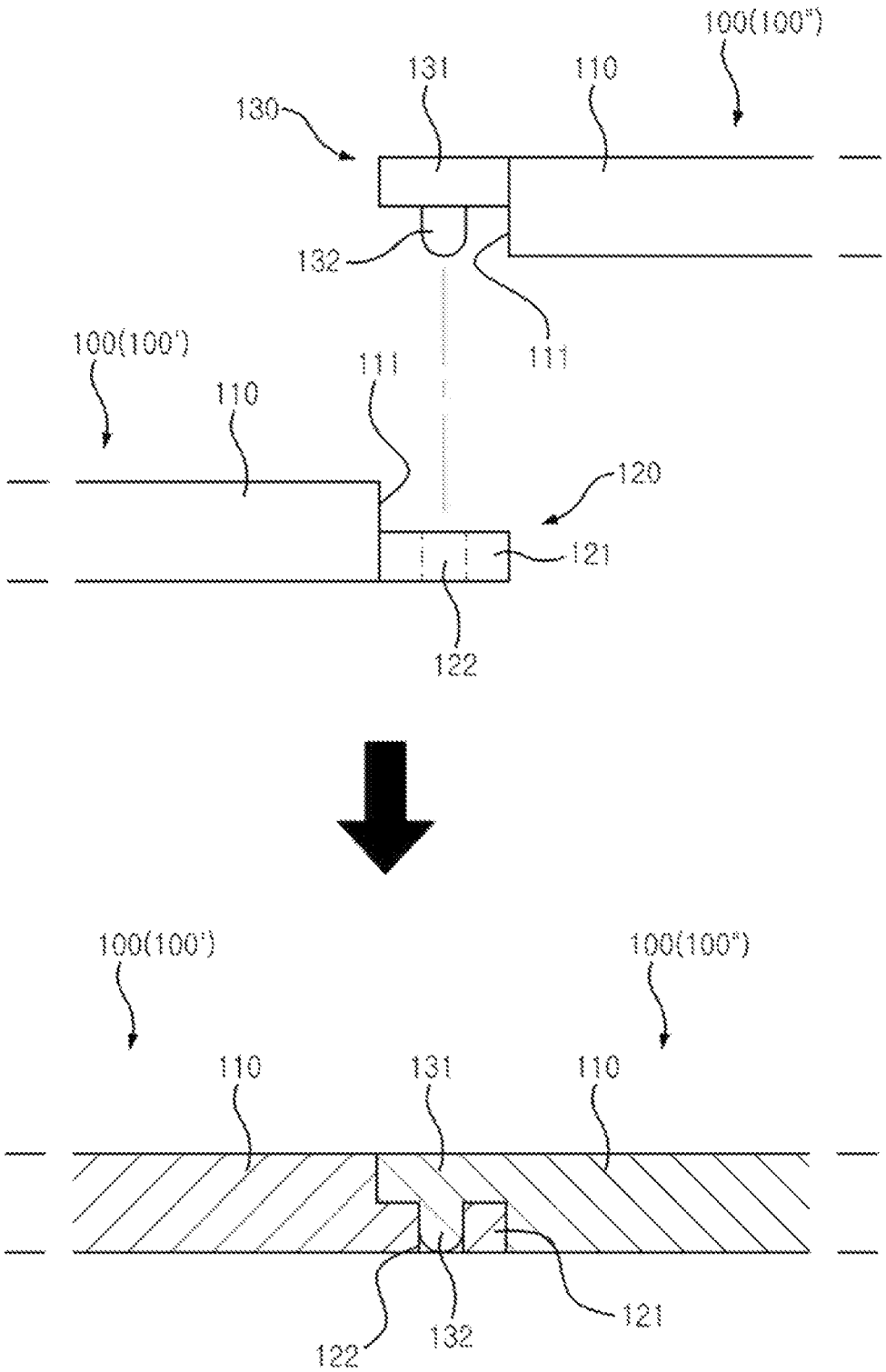
FIG. 8 is a partial enlarged coupling view illustrating another example of female and male fastening protrusions of FIG. 6.

As illustrated in FIG. 8, one fastening protrusion of the female and male fastening protrusions 121 and 131 has a coupling space 122 including a groove or a hole in an adjoining surface, and the other fastening protrusion includes a coupling protrusion 132 coupled into the coupling space 122.

For example, the female fastening protrusion 121 has the coupling space 122, and the male fastening protrusion 131 includes the coupling protrusion 132.

The coupling protrusion 132 is coupled into the coupling space 122 and allows the female and male fastening protrusions 121 and 131 to be stably coupled without separation.

Hence, the present disclosure can facilitate the coupling between the adjacent panels 100 and improve the adhesive strength when the plurality of panels 100 forming the surface of the ball game ball 10 is attached.

Figure 9:
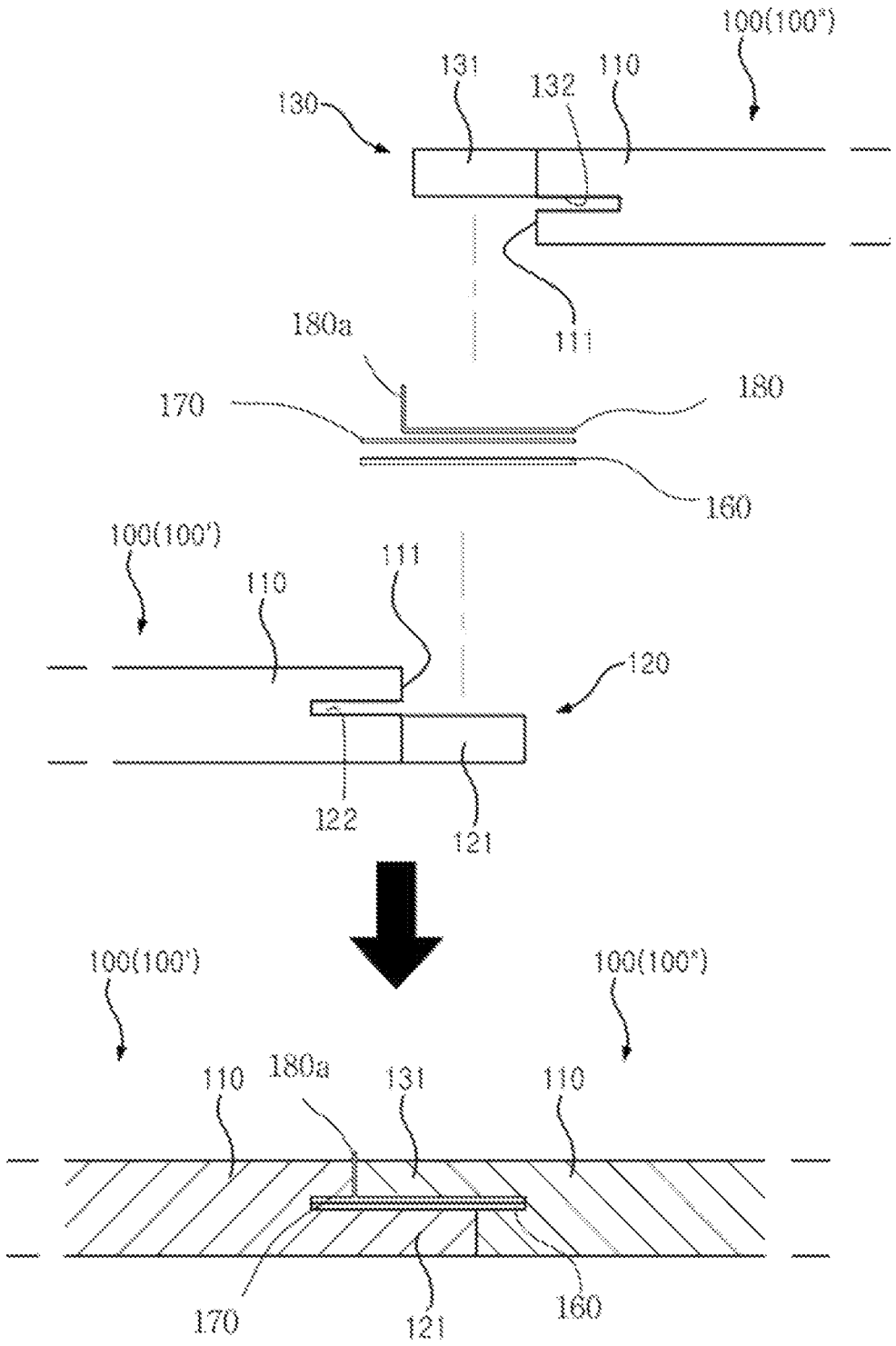
FIG. 9 is a partial enlarged coupling view illustrating a panel for ball game ball and a ball game ball including the panel according to another embodiment of the present disclosure.

FIG. 9 illustrates a panel for ball game ball and a ball game ball including the panel according to another embodiment of the present disclosure.

As illustrated in FIG. 9, the present embodiment includes a plurality of panels 100 that is attached to each other by an adhesive to form a surface of a ball game ball 10, and the panel 100 for ball game ball includes an attachment plate 110 and a female fastening portion 120 and a male fastening portion 130 formed around the attachment plate 110.

The female fastening portion 120 includes a female fastening protrusion 121 included in at least one of a plurality of sides 111. The male fastening portion 130 includes a male fastening protrusion 131 included in a side, among the plurality of sides 111, in which the female fastening portion 120 is not included.

Hence, the panel 100 may include the plurality of attachment plates HO in which the female fastening portion 120 or the male fastening portion 130 is formed on all the sides 111 of the attachment plate 110, or both the female and male fastening portion 120 and 130 are formed together on all the sides 111.

Preferably when the female fastening protrusion 121 is extended from a lower part of the side 111 to the outside and the male fastening protrusion 131 is extended from an upper part of the side 111 to the outside. When the two adjacent panels 100 are attached, a male fastening protrusion 131 included in one panel 100' may be attached to an upper part of a female fastening protrusion 121 included in another panel 100".

A male cut groove 132 with a predetermined height and length is formed in the rear of the male fastening protrusion 131, and a female cut groove 122 with a predetermined height and length is formed in the rear of the female fastening protrusion 121. The female cut groove 122 and the male cut groove 132 may be formed by cutting the side 111 of the attachment plate 110 in a horizontal direction.

In addition, a carbon fiber sheet 170 is installed between the female fastening protrusion 121 and the male fastening protrusion 131. The carbon fiber sheet 170 is formed by Weaving a plurality of carbon fiber strands, and may have a flat rectangular shape. In general, the carbon fiber sheet 170 has flexible, light, and tough characteristics. Thus, when the carbon fiber sheet 170 is inserted between the female fastening protrusion 121 and the male fastening protrusion 131 and is attached by an adhesive, a coupling strength between the two panels 100 can be further improved.

Both left and right ends of the carbon fiber sheet 170 may be inserted into the male cut groove 132 and the female cut groove 122. That is, when the carbon fiber sheet 170 is installed between the female fastening protrusion 121 and the male fastening protrusion 131, the coupling strength between the two panels 100 can be further improved if the left and right ends of the carbon fiber sheet 170 are respectively inserted into the male cut groove 132 and the female cut groove 122 and then are attached by the adhesive.

In addition, in the present embodiment, a printed circuit board 160 may be further installed between the female fastening protrusion 121 and the male fastening protrusion 131. Preferably, the printed circuit board 160 is installed on a lower surface of a first carbon fiber sheet 170. A second carbon fiber sheet 180 is further installed on an upper surface of the first carbon fiber sheet 170. In this instance, the printed circuit board 160 is a flexible printed circuit board (FPCB) and is freely flexible, and the first carbon fiber sheet 170 and the second carbon fiber sheet 180 are 'metal-coated carbon fibers' in which a metal is coated on a surface of a carbon fiber, and entirely have conductivity.

Figure 10:
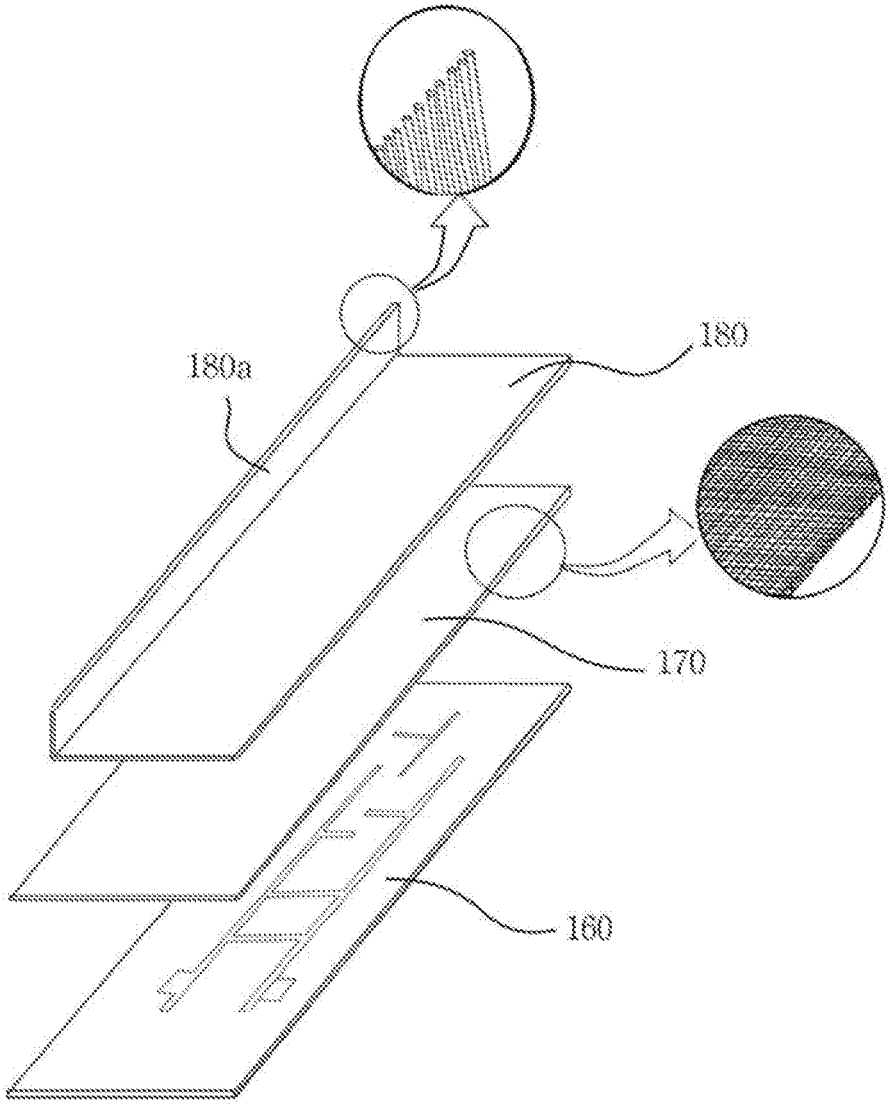
FIG. 10 is a perspective view illustrating an example of a carbon fiber sheet and a printed circuit board applied to a panel for ball game ball and a ball game ball including the panel illustrated in FIG. 9.

Preferably, as illustrated in FIG. 10, a predetermined pattern may be printed on an upper surface or a lower surface of the printed circuit board 160, and various electronic components may be mounted on the printed circuit board 160. For example, various measurement sensors and a transceiver capable of short-range wireless communication may be installed on the printed circuit board 160. The first carbon fiber sheet 170 is a carbon fiber sheet formed by weaving warp and weft, and is attached to the upper surface of the printed circuit board 160 using an adhesive to protect the printed circuit board 160. At the same time, at least a portion of the first carbon fiber sheet 170 electrically contacts the second carbon fiber sheet 180 and is electrically connected to the second carbon fiber sheet 180.

A tassel 180*a* made of conductive carbon fiber strands is formed on at least one side of the second carbon fiber sheet 180. The tassel 180*a* is upward bent and protrudes to the outside of the panel 100 by a predetermined length. Thus, the second carbon fiber sheet 180 is electrically connected to the printed circuit board 160 through the first carbon fiber sheet 170 and enables the first carbon fiber sheet 170 to be wiredly/wirelessly connected to an electronic measuring device, that is positioned outside the panel 100, through the tassel 180*a*.

As described above, according to the present embodiment, a portion of the second carbon fiber sheet 180 with the conductivity protrudes to the surface of the ball game ball 10 by a predetermined length, and can electrically communicate with the electronic measuring device that is outside the ball game ball 10. Further, according to the present embodiment, the printed circuit board 160 installed inside the ball game ball 10 can be wiredly/wirelessly connected to the electronic measuring device, that is positioned outside the ball game ball 10, through the first and second carbon fiber sheets 170 and 180 with the conductivity. Thus, an external signal can be transferred to the printed circuit board 160, that is installed inside the ball game ball 10, through the second carbon fiber sheet 180, or a signal sensed by the printed circuit board 160 can be transferred to the electronic measuring device, that is outside the ball game ball 10, through the second carbon fiber sheet 180.

Although the embodiments have been described with reference to a number of illustrative embodiments thereof, numerous other modifications and embodiments may be devised by those skilled in the art that will fall within the scope of the principles of this disclosure. In particular, various Variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A panel for ball game ball comprising:

an attachment plate having a plurality of sides around the attachment plate;

a female fastening portion including a female fastening protrusion included in at least one of the plurality of sides; and a male fastening portion including a male fastening protrusion included in a side, among the plurality of sides, in which the female fastening portion is not included, wherein the female fastening portion and the male fastening portion are attached to each other by an adhesive to form a surface of a ball game ball, wherein the female fastening protrusion and the male fastening protrusion are extended to the outside by a predetermined length so that the male fastening protrusion included in one attachment plate is attached to an upper part or a lower part of the female fastening protrusion included in another attachment plate, wherein a first carbon fiber sheet is further disposed between the female fastening protrusion and the male fastening protrusion, and the first carbon fiber sheet is formed by weaving a plurality of carbon fiber strands and has a flat rectangular shape.

2. The panel for ball game ball of claim 1, further comprising:

a printed circuit board is disposed on a lower surface of the first carbon fiber sheet, and a second carbon fiber sheet is disposed on an upper surface of the first carbon fiber sheet, wherein the first and second carbon fiber sheets are metal-coated carbon fibers in which a metal is coated on a surface of a carbon fiber, and have conductivity.

3. The panel for ball game ball of claim 2, further comprising:

a male cut groove with a predetermined height and length is formed in the rear of the male fastening protrusion, and a female cut groove with a predetermined height and length is formed in the rear of the female fastening protrusion, wherein the printed circuit board, both ends of the first carbon fiber sheet, and one end of the second carbon fiber sheet are inserted into the male cut groove and the female cut groove.

4. The panel for ball game ball of claim 2, wherein one side of the second carbon fiber sheet is made of a plurality of carbon fiber strands, upward bends to pass between the adjacent panels, and protrudes to the outside of the panel by a predetermined length.

5. A ball game ball including a panel according to claim 4.

* * * * *